US008839531B2

(12) United States Patent
Sullivan et al.

(10) Patent No.: US 8,839,531 B2
(45) Date of Patent: Sep. 23, 2014

(54) FOOTWEAR

(75) Inventors: Daniel A. Sullivan, Dover, MA (US); Christopher J. Mahoney, Concord, MA (US)

(73) Assignee: Saucony IP Holdings LLC, Rockford, MI (US)

( * ) Notice: Subject to any disclaimer, the term of this patent is extended or adjusted under 35 U.S.C. 154(b) by 422 days.

(21) Appl. No.: 13/186,233

(22) Filed: Jul. 19, 2011

(65) Prior Publication Data

US 2013/0019497 A1 Jan. 24, 2013

(51) Int. Cl.

*A43B 13/18* (2006.01)
*A43B 13/12* (2006.01)
*A43B 7/14* (2006.01)

(52) U.S. Cl.

CPC ..... *A43B 13/127* (2013.01); *A43B 13/187* (2013.01); *A43B 7/144* (2013.01)
USPC ..... 36/28; 36/30 R; 36/25 R

(58) Field of Classification Search

CPC ..... A43B 7/144; A43B 7/14; A43B 7/1405; A43B 13/143; A43B 13/148; A43B 13/127; A43B 13/187; A43B 21/32
USPC ..... 36/30 R, 25 R, 31, 28, 35 R, 103, 37, 36/143, 144, 142
See application file for complete search history.

(56) References Cited

U.S. PATENT DOCUMENTS

| | | | | |
|---|---|---|---|---|
| 290,460 | A | | 12/1883 | Mitchell |
| 955,337 | A | | 4/1910 | Lawlor |
| 1,242,363 | A | | 10/1917 | Mueller et al. |
| 1,949,318 | A | | 2/1934 | Markowsky |
| 2,194,637 | A | | 3/1940 | Burger |
| 2,311,996 | A | | 11/1940 | Parker |
| 2,298,941 | A | | 10/1942 | Herrmann |
| 2,367,808 | A | * | 1/1945 | Starner ..... 36/30 R |
| 3,040,454 | A | | 6/1962 | Topper et al. |
| 3,124,887 | A | | 3/1964 | Vassar |
| 3,535,800 | A | | 10/1970 | Stöhr |
| 3,821,858 | A | | 7/1974 | Haselden |
| 4,447,967 | A | | 5/1984 | Zaino et al. |
| 4,506,462 | A | * | 3/1985 | Cavanagh ..... 36/92 |
| 4,534,122 | A | | 8/1985 | MacPhail |
| 4,562,652 | A | | 1/1986 | Hensler |
| 4,677,769 | A | | 7/1987 | Ahmad et al. |

(Continued)

FOREIGN PATENT DOCUMENTS

| | | |
|---|---|---|
| CN | 2599958 Y | 1/2004 |
| DE | 2751146 A1 | 5/1979 |

(Continued)

OTHER PUBLICATIONS

International Search Report for application PCT/US2012/046149 dated Oct. 29, 2012.

*Primary Examiner* — Jila M Mohandesi
(74) *Attorney, Agent, or Firm* — Warner Norcross & Judd LLP

(57) ABSTRACT

A footwear sole assembly that includes a midsole, a strike pad disposed on the midsole in at least a heel region of the footwear sole assembly, and an outsole disposed on the strike pad. A heel top surface of the footwear sole assembly is elevated between about 4 mm and about 12 mm above a forefoot top surface of the footwear sole assembly.

20 Claims, 11 Drawing Sheets

(56) References Cited

U.S. PATENT DOCUMENTS

| | | | | |
|---|---|---|---|---|
| 4,769,928 | A | 9/1988 | Ward | |
| 4,798,010 | A | 1/1989 | Sugiyama | |
| 4,839,972 | A | 6/1989 | Pack et al. | |
| 4,854,057 | A * | 8/1989 | Misevich et al. | 36/114 |
| 4,858,339 | A | 8/1989 | Hayafuchi et al. | |
| 4,890,397 | A * | 1/1990 | Harada et al. | 36/30 R |
| 4,920,666 | A | 5/1990 | Marega | |
| 4,989,350 | A | 2/1991 | Bunch et al. | |
| 5,243,772 | A | 9/1993 | Francis et al. | |
| 5,606,806 | A | 3/1997 | O'Dwyer | |
| 5,711,092 | A | 1/1998 | Despres et al. | |
| 5,732,481 | A * | 3/1998 | Farhad | 36/44 |
| 5,752,331 | A | 5/1998 | Perrissoud et al. | |
| 5,884,420 | A | 3/1999 | Donnadieu | |
| 5,956,868 | A | 9/1999 | Stevens et al. | |
| 5,996,251 | A | 12/1999 | LaDuca | |
| 6,076,286 | A | 6/2000 | Donnadieu | |
| 6,305,103 | B1 | 10/2001 | Camargo | |
| 6,321,468 | B1 | 11/2001 | DeGrand et al. | |
| 6,349,487 | B1 | 2/2002 | Hice | |
| 6,374,515 | B1 | 4/2002 | Davis | |
| 6,684,532 | B2 * | 2/2004 | Greene et al. | 36/28 |
| 6,745,498 | B2 | 6/2004 | LaDuca | |
| 6,817,116 | B2 | 11/2004 | Chil et al. | |
| 7,051,458 | B2 | 5/2006 | LaDuca | |
| 7,690,132 | B2 | 4/2010 | Wilkenfeld | |
| 7,730,634 | B2 | 6/2010 | LaDuca | |
| 7,814,683 | B2 * | 10/2010 | Lee | 36/28 |
| 7,823,298 | B2 | 11/2010 | Nishiwaki et al. | |
| 7,900,380 | B2 | 3/2011 | Rich | |
| 8,316,558 | B2 * | 11/2012 | Teteriatnikov et al. | 36/25 R |
| 2001/0032400 | A1 | 10/2001 | Brooks | |
| 2002/0078591 | A1 | 6/2002 | Morrone | |
| 2004/0194344 | A1 | 10/2004 | Tadin | |
| 2007/0107264 | A1 | 5/2007 | Meschter et al. | |
| 2007/0107265 | A1 | 5/2007 | Mueller et al. | |
| 2008/0016724 | A1 * | 1/2008 | Hlavac | 36/30 R |
| 2010/0083535 | A1 | 4/2010 | Meschter et al. | |
| 2010/0146817 | A1 | 6/2010 | Crispo | |
| 2011/0009982 | A1 | 1/2011 | King et al. | |

FOREIGN PATENT DOCUMENTS

| | | | |
|---|---|---|---|
| DE | 3415960 | A1 | 11/1984 |
| DE | 4018518 | A1 | 1/1991 |
| DE | 10319480 | A1 | 11/2004 |
| EP | 0047710 | A1 | 3/1982 |
| EP | 0234908 | A2 | 9/1987 |
| EP | 0500247 | A2 | 8/1992 |
| EP | 0562697 | A1 | 9/1993 |
| EP | 1702593 | A1 | 9/2006 |
| GB | 651477 | A | 4/1951 |
| GB | 2429394 | A | 2/2007 |
| JP | 33005240 | | 4/1958 |
| JP | 59108405 | A | 6/1984 |
| JP | 60018082 | A | 1/1985 |
| JP | 01026245 | A | 1/1989 |
| JP | 01139710 | A | 6/1989 |
| JP | 02116807 | A | 5/1990 |
| JP | 03010154 | A | 1/1991 |
| JP | 03025914 | A | 2/1991 |
| JP | 4107608 | A | 4/1992 |
| JP | 06019157 | A | 1/1994 |
| JP | 07011966 | A | 1/1995 |
| JP | 08317806 | A | 12/1996 |
| JP | 11000636 | A | 1/1999 |
| JP | 11018803 | A | 1/1999 |
| JP | 2000184902 | A | 7/2000 |
| JP | 2000287704 | A | 10/2000 |
| JP | 2002209608 | A | 7/2002 |
| JP | 2002345506 | A | 12/2002 |
| WO | WO-0074514 | A1 | 12/2000 |
| WO | WO-2007059017 | A1 | 5/2007 |

* cited by examiner

FOOTWEAR

TECHNICAL FIELD

This disclosure relates to footwear.

BACKGROUND

Articles of footwear, such as shoes, are generally worn while exercising to protect and provide stability of a user's feet. In general, shoes include an upper portion and a sole. When the upper portion is secured to the sole, the upper portion and the sole together define a void that is configured to securely and comfortably hold a human foot. Often, the upper portion and/or sole are/is formed from multiple layers that can be stitched or adhesively bonded together. For example, the upper portion can be made of a combination of leather and fabric, or foam and fabric, and the sole can be formed from at least one layer of natural rubber. Often materials are chosen for functional reasons, e.g., water-resistance, durability, abrasion-resistance, and breathability, while shape, texture, and color are used to promote the aesthetic qualities of the shoe. The sole generally provides support for a user's foot and acts as an interface between the user's foot and the ground.

SUMMARY

One aspect of the disclosure provides a footwear sole assembly that includes a midsole, a strike pad disposed on the midsole in at least a heel region of the footwear sole assembly, and an outsole disposed on the strike pad. A heel top surface of the footwear sole assembly is elevated between about 4 mm and about 12 mm above a forefoot top surface of the footwear sole assembly.

Implementations of the disclosure may include one or more of the following features. In some implementations, the heel top surface of the footwear sole assembly generally receives and supports a calcaneus bone of a received foot and the forefoot top surface of the footwear sole assembly generally receives and supports metatarsal-phalanges joints of the received foot. The heel top surface of the footwear sole assembly may be elevated about 8 mm above the forefoot top surface of the footwear sole assembly (i.e., a heel-to-toe drop of about 8 mm). This may allow a mid-foot strike gait. Running with a mid-foot strike gait can set the runner's ankles, calves, knees, quadriceps and/or hamstrings in a position that may better receive and absorb impact forces associated with striking the ground, relative to a heel-to-toe drop greater than 8 mm. Moreover, a heel-to-toe drop of about 8 mm can place the runner's legs in a relatively more coiled position, allowing the runner's legs to receive ground strike forces like a spring and then rebound to propel the runner forward.

In some implementations, the strike pad extends laterally from a lateral edge of the midsole to between about 10% and about 80% of a width of a heel portion of the footwear sole assembly. The strike pad may extend along a lateral periphery of the midsole from a heel end of the sole assembly to a metatarsal portion of the sole assembly. In some examples, the strike pad has a thickness of between about 5 mm and about 40 mm. Moreover, the thickness of the strike pad may decrease (e.g., linearly, parabolic, or step-function) from a heel end of the sole assembly to a metatarsal portion of the sole assembly. The strike pad may be disposed substantially in a lateral-heel portion of the sole assembly for receiving initial lateral ground contact forces.

Another aspect of the disclosure provides a method of locomotion across a ground surface. The method includes contacting the ground surface with a footwear sole assembly, elevating a heel bottom of a received foot between about 4 mm and about 12 mm above a forefoot bottom of the received foot, and receiving an initial ground contact force on a strike pad disposed on a midsole in at least a heel region of the footwear sole assembly. The method further includes rolling the footwear sole assembly forward onto the ground surface and pushing off of the ground surface, elevating the footwear sole assembly away from the ground surface.

In some implementations, the method includes elevating the heel bottom of the received foot about 8 mm above the forefoot bottom of the received foot, allowing a mid-foot strike gait. The method may include receiving and supporting a calcaneus bone of a user on a heel top surface of the footwear sole assembly and receiving and supporting metatarsal-phalanges joints of the user on a forefoot top surface of the footwear sole assembly. The heel top surface of the footwear sole assembly may be elevated between about 4 mm and about 12 mm above the forefoot top surface of the footwear sole assembly. For example, the heel top surface of the footwear sole assembly may be elevated about 8 mm above the forefoot top surface of the footwear sole assembly.

The method may include easing the runner into a natural gait cycle through a gradual absorption of compressive forces by the strike pad. In some implementations, the strike pad extends laterally from a lateral edge of the midsole to between about 10% and about 80% of a width of a heel portion of the footwear sole assembly. The method, in some examples, includes receiving initial lateral contact forces in the strike pad, the strike pad extending along a lateral periphery of the midsole from a heel end of the sole assembly to a metatarsal portion of the sole assembly. The method, in additional examples, includes receiving initial lateral contact forces in the strike pad, where the strike pad is disposed substantially in a lateral-heel portion of the sole assembly.

The strike pad may have a thickness of between about 5 mm and about 40 mm. Moreover, the thickness of the strike pad may decrease (e.g., linearly, parabolic, or step-function) from a heel end of the sole assembly to a metatarsal portion of the sole assembly.

The details of one or more implementations of the disclosure are set forth in the accompanying drawings and the description below. Other aspects, features, and advantages will be apparent from the description and drawings, and from the claims.

Figure 1:
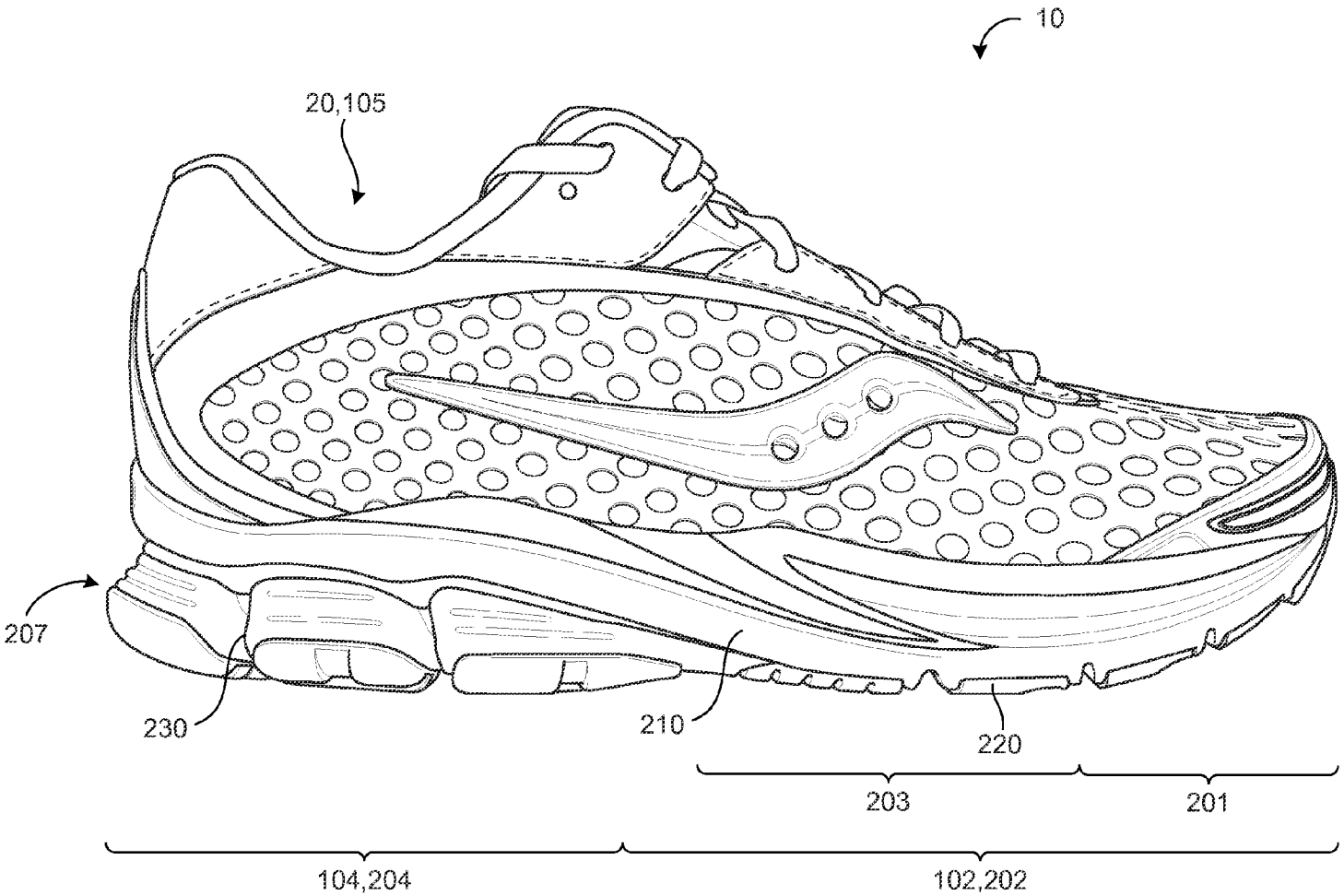
FIG. 1 is a side view of an exemplary footwear article.
Figure 2:
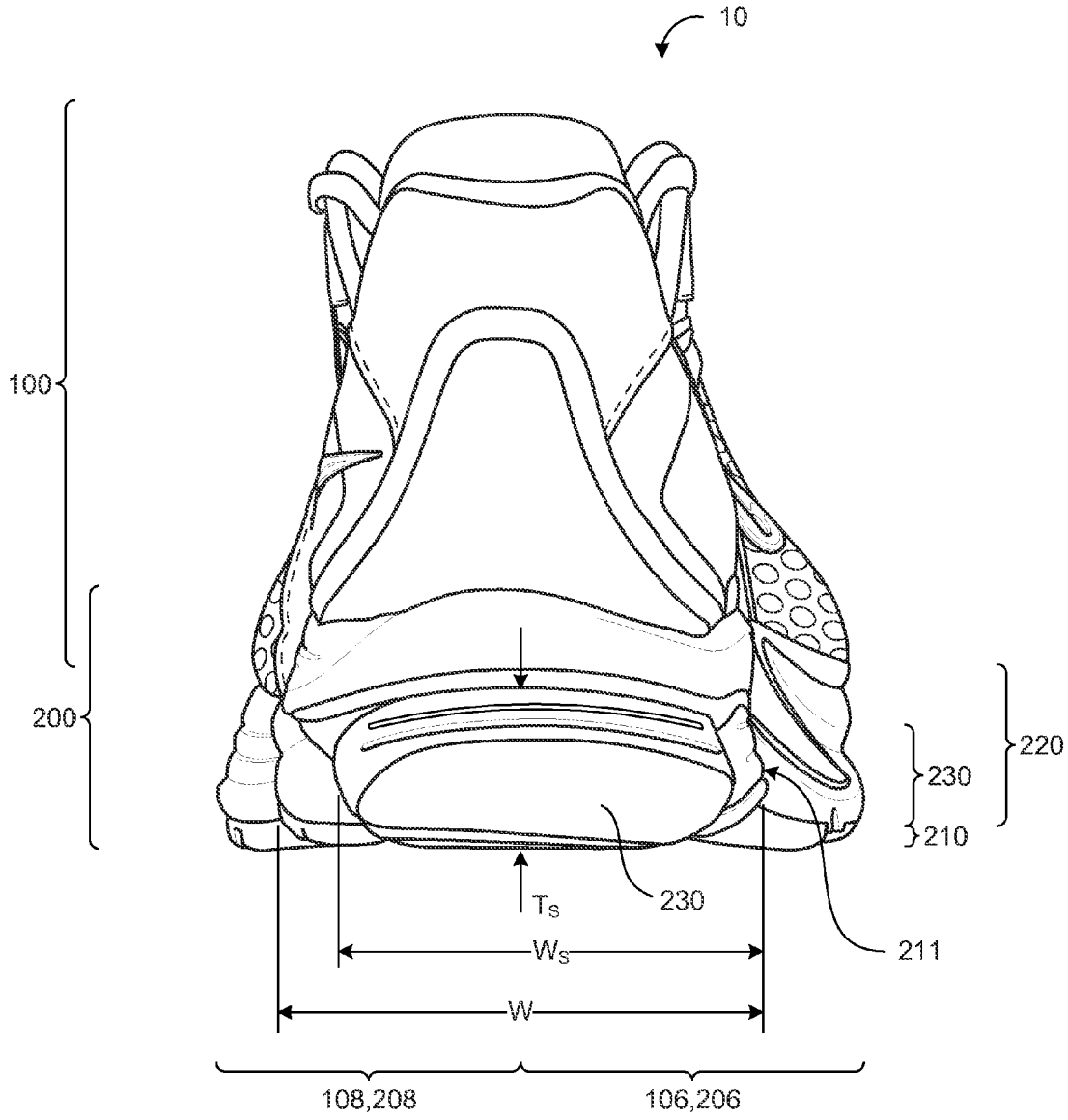
FIG. 2 is a rear view of the footwear article shown in FIG. 1.
Figure 3:
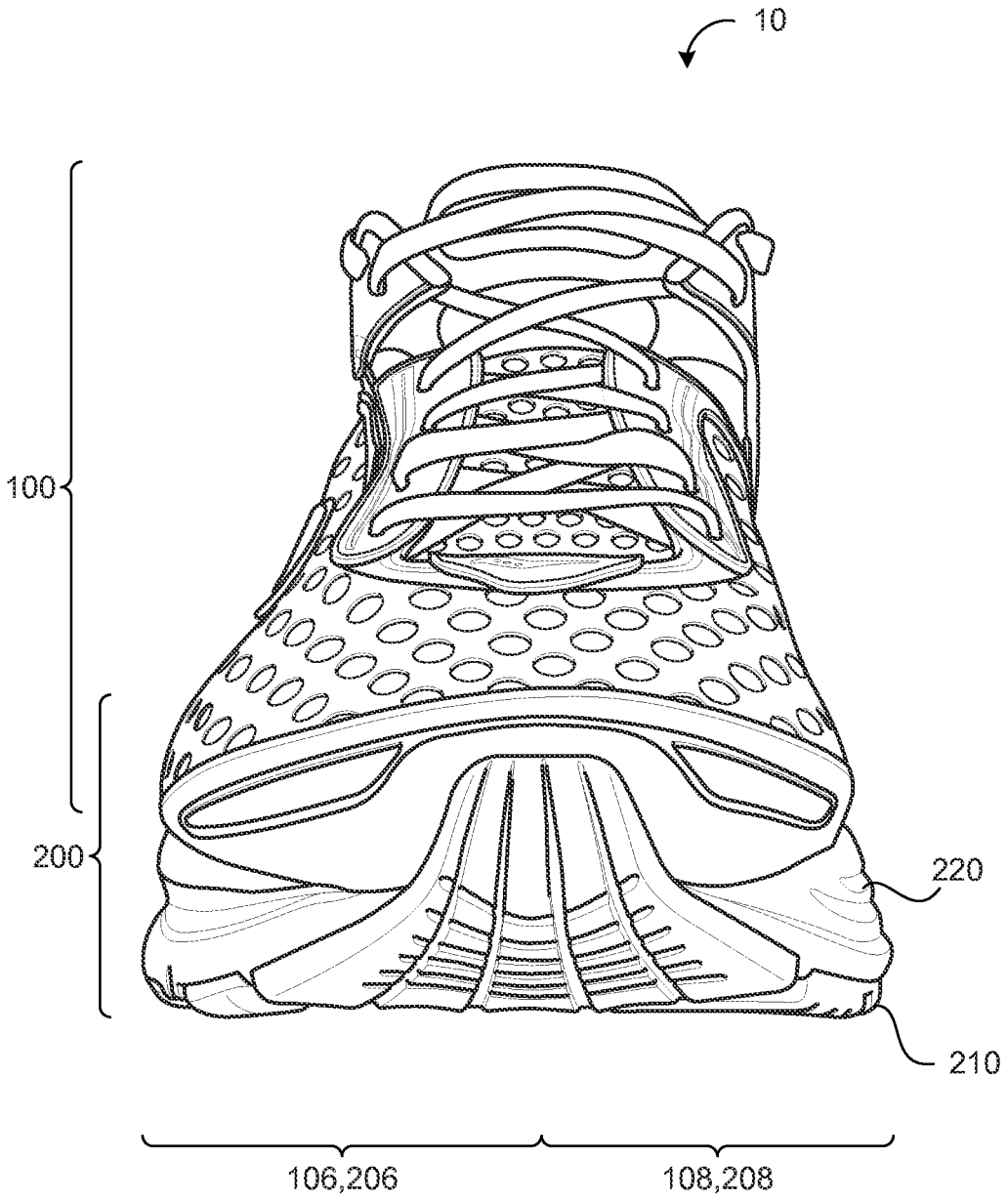
FIG. 3 is a front view of the footwear article shown in FIG. 1.
Figure 4:
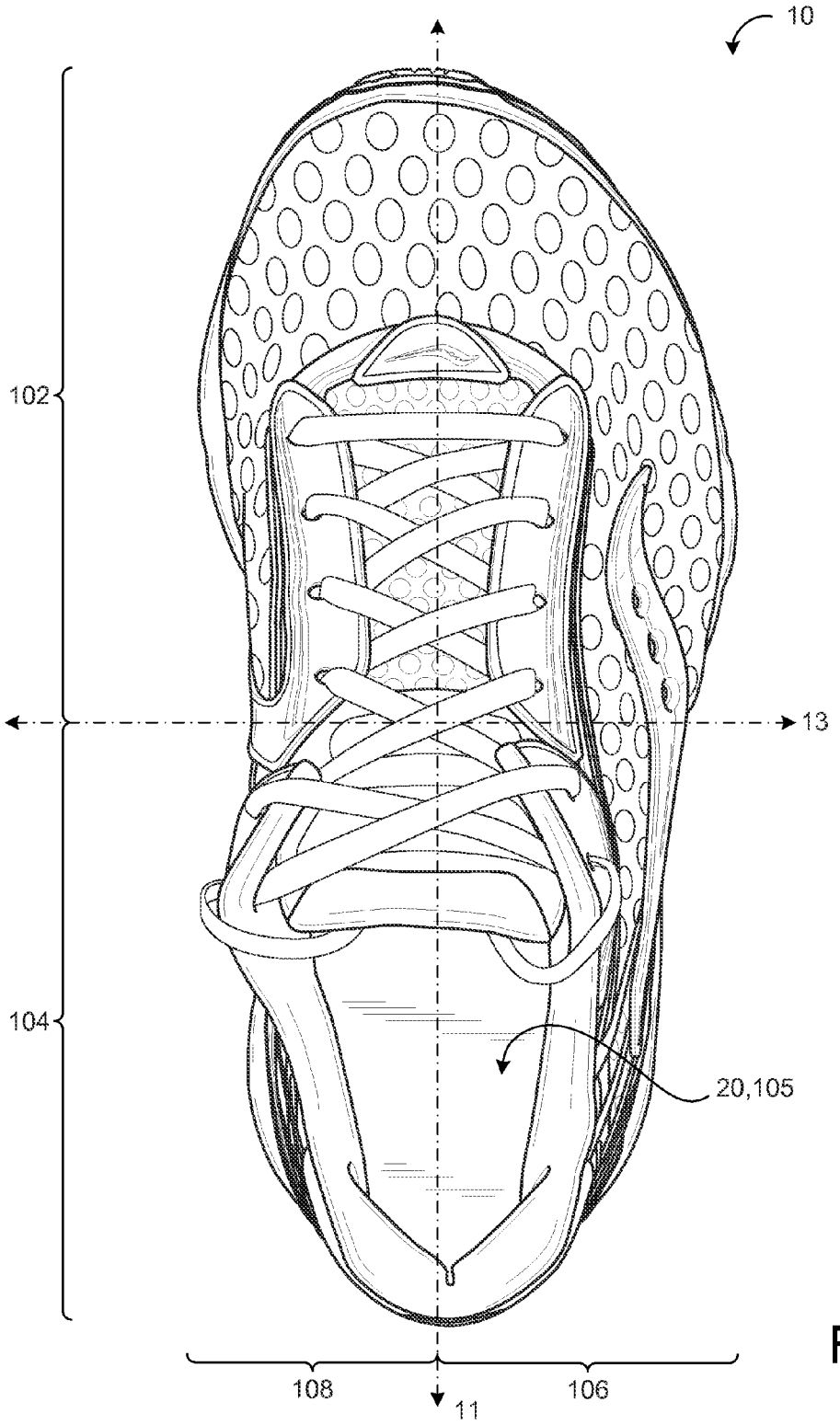
FIG. 4 is a top view of the footwear article shown in FIG. 1.
Figure 5:
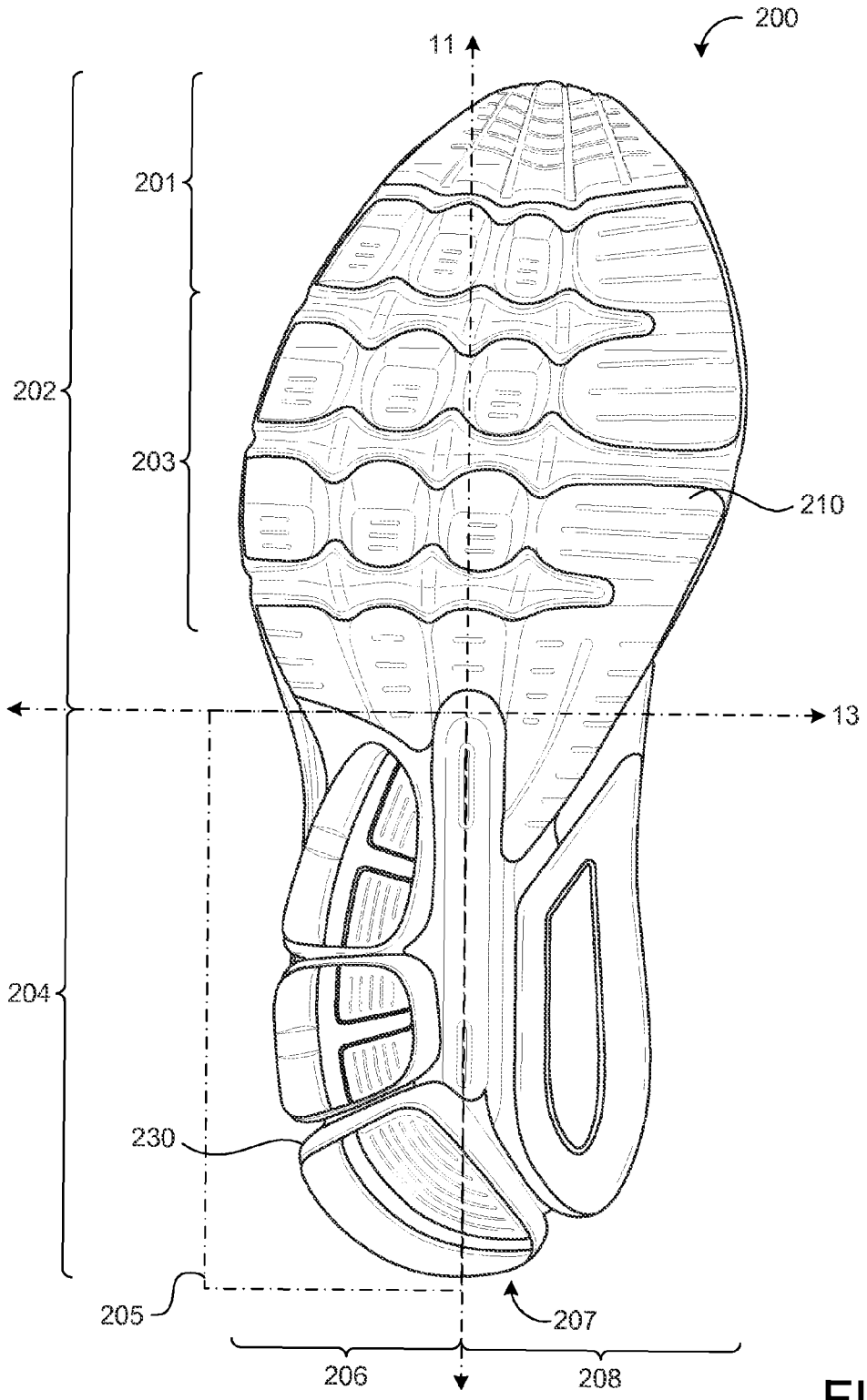
FIG. 5 is a bottom view of an exemplary footwear sole assembly.

Like reference symbols in the various drawings indicate like elements. By way of example only, all of the drawings are directed to an article of footwear suitable to be worn on a right foot. The invention also includes the mirror images of the drawings, i.e. an article of footwear suitable to be worn on a left foot.

DETAILED DESCRIPTION

Referring to FIGS. 1-5, in some implementations, an article of footwear 10 includes an upper assembly 100 attached to a sole assembly 200 (e.g., by stitching and/or an adhesive). Together, the upper assembly 100 and the sole assembly 200 define a foot void 20 configured to securely and comfortably hold a human foot. The upper assembly 100 defines a foot opening 105 for receiving a human foot into the foot void 20. The footwear article 10 defines perpendicular longitudinal and transverse axes 11, 13. The upper assembly 100 and the sole assembly 200 each have a corresponding forefoot portion 102, 202 and a corresponding heel portion 104, 204. The forefoot portions 102, 202 may be generally associated with the metatarsals, phalanges, and interconnecting joints thereof of a received foot. The heel portions 104, 204 may be generally associated with the heel of the received foot, including the calcaneus bone. Moreover, the upper assembly 100 and the sole assembly 200 each have a corresponding lateral portion 106, 206 and a corresponding medial portion 108, 208, opposite each other. The upper assembly 100 and the sole assembly 200 also include corresponding phalanges portions 101, 201 and metatarsal portions 103, 203. The phalanges portions 101, 201, forefoot portions 102, 204, metatarsal portions 103, 203, and heel portions 104, 204 are only intended for purposes of description and do not demarcate precise regions of the footwear article 10. Likewise, the lateral portions 106, 206 and the medial portions 108, 208 generally represent two sides of the footwear article 10, rather than precise demarcations of two halves of the footwear article 10. Although the examples shown illustrate a running shoe, the footwear article 10 may be configured as other types of footwear, including, but not limited to shoes, boots, sandals, flip-flops, clogs, etc.

Referring to FIGS. 5-8, in some implementations, the sole assembly 200 includes a midsole 210 and an outsole 220 supporting the midsole 210. The outsole 210 may have a durometer of between about 40 Shore A and about 70 Shore A (e.g., 50 Shore A). The midsole 220 can be made of a polyurethane or ethylene vinyl acetate (EVA) and have a durometer of between about 50 Shore A and about 70 Shore A (e.g., between about 60 Shore A and about 65 Shore A).

Figure 6:
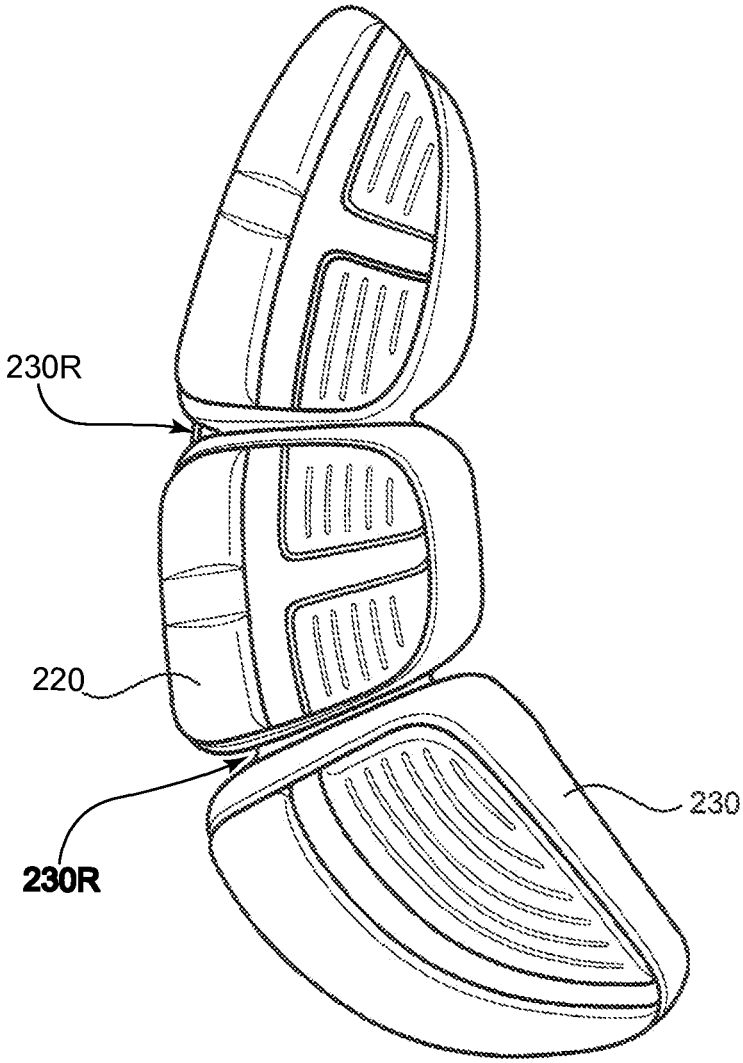
FIG. 6 is a bottom view of an exemplary strike pad.
Figure 7:
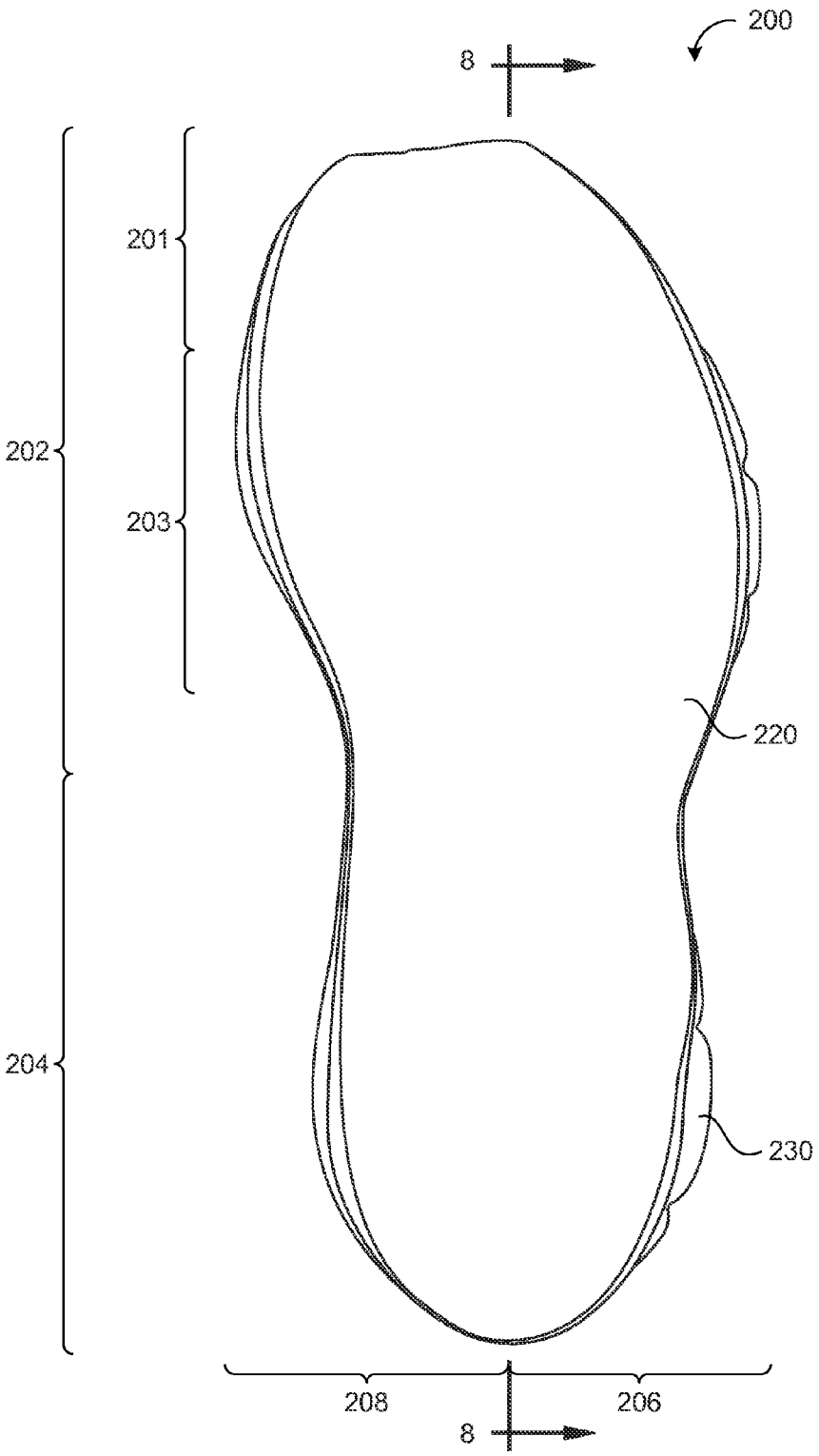
FIG. 7 is a top view of an footwear sole assembly shown in FIG. 5.
Figure 8:
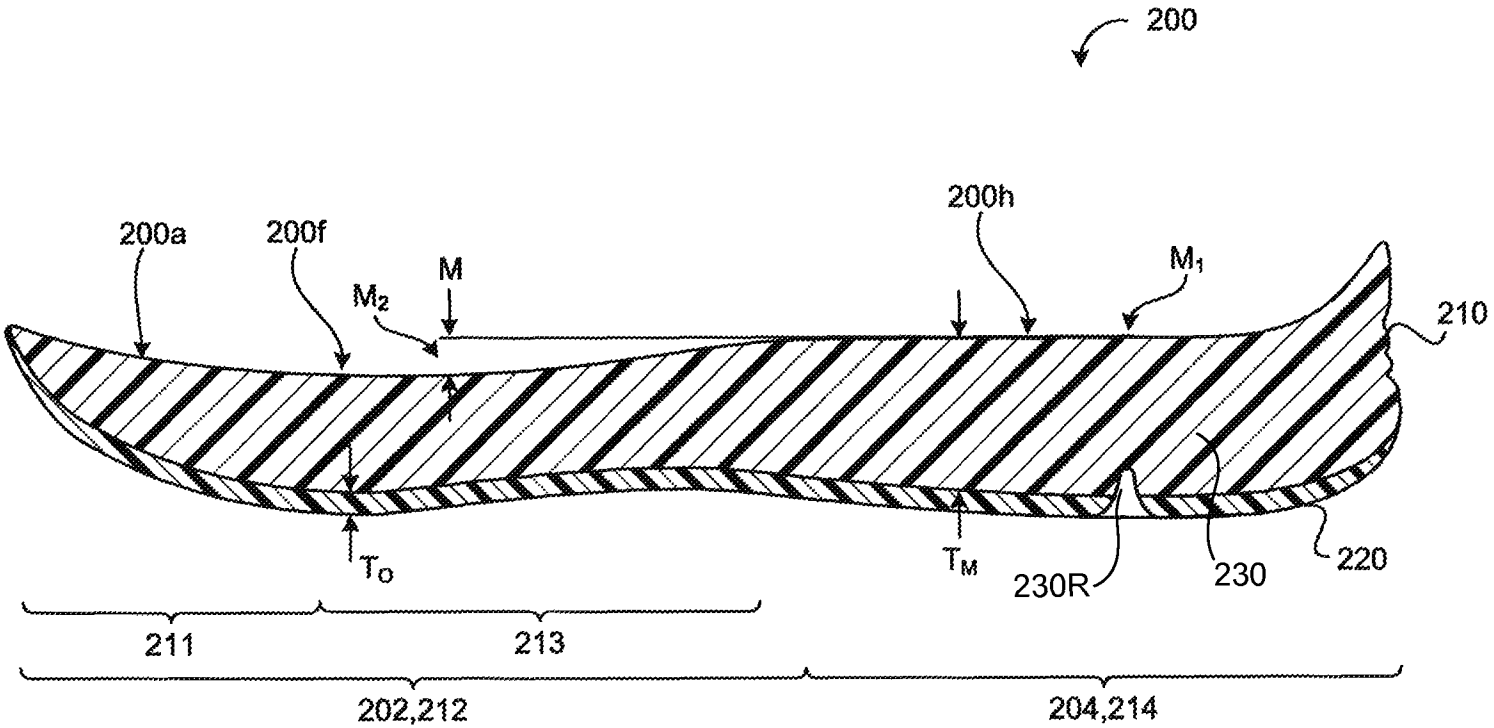
FIG. 8 is a section view of the footwear sole assembly shown in FIG. 7, along line 8-8.

The sole assembly 200 may include a strike pad 230 supporting the midsole 210 in at least the heel portion 204 of the sole assembly 200. In the example shown, the strike pad 230 is disposed between a portion of the outsole 220 and the midsole 210, so that the outsole 210 (e.g., of a relatively harder durometer) receives any ground abrasion. The strike pad 230 provides cushioning to the sole assembly 200 for receiving initial ground-strike impact forces and easing the runner into a natural gait cycle due to a gradual absorption of compressive forces. The strike pad 230 can be made of a polyurethane or ethylene vinyl acetate (EVA) and/or may have a durometer of between about 40 Asker C and about 65 Asker C. The strike pad 230 may comprise a material that compresses in an elastic manner. The elastic compression (i.e., absorption of a compressing force) can be linear, exponential, or parabolic. FIGS. 6 and 8 show several individual parts of the strike pad 230. These individual strike pad parts can be separated with one or more recesses 230R as illustrated. As further illustrated in FIGS. 6 and 8, the outsole 220 can include separate individual outsole parts which are each joined with the respective strike pad parts. As shown in FIG. 8, the midsole 210 is located immediately above and joined with the strike pad 230. As further illustrated there, the midsole can extend downwardly into the strike pad and form at least part of one or more strike pads.

In some implementations, the outsole 210, the midsole 220, and the strike pad 230 each have different durometers, such that the outsole 210 has the hardest durometer relative to the midsole 220 and the strike pad 230, so as to provide wear and abrasion resistance along the bottom surface of the sole assembly 200. The strike pad 230 may have a relatively softer durometer than the midsole 220, so as to provide additional cushioning (e.g., in a lateral-heel portion 205 of the sole assembly 200) to receive and dissipate initial ground contact forces.

The strike pad 230 can be disposed only in the heel portion 204 of the sole assembly 200 or extend from the heel portion 204 to or into the phalanges portion 201, the metatarsal portion 203, or the forefoot portion 204 of the sole assembly 200. In the example shown, the strike pad 230 extends from a heel end 207 of the sole assembly 200 to the metatarsal portion 203. Since runners generally land initially on the lateral portion 206 of the sole assembly 206, before rolling onto the medial portion 208, the strike pad 230 can be disposed on the lateral portion 206 of the sole assembly 200, for example, in the lateral-heel portion 205 of the sole assembly 200. In some instances, the strike pad 230 extends laterally from a lateral edge 211 of the midsole 210 to between about 10% and about 80% of a width W of the heel portion 204 of the sole assembly 200 (e.g., half way across the width W of the sole assembly heel portion 204). The strike pad 230 may extend along a lateral periphery of the midsole 210 from the heel end 207 of the sole assembly 200 to the metatarsal portion 203, for example, defining a substantially J-shape from a bottom plan view perspective. In additional examples, the strike pad 230 defines a crescent, half-moon, substantially "U" shape, or an arcuate shape in a bottom plan view. In some examples, the strike pad 230 has a thickness $T_S$ (FIG. 2) of between about 5 mm and about 40 mm. Moreover, the strike pad thickness $T_S$ may decrease in thickness from the heel end 207 to the metatarsal portion 203 of the sole assembly 200 (e.g., gradually, linearly, non-linearly, exponentially, step-function, etc.).

Referring to FIG. 8, in some implementations, the sole assembly 200 provides a heel-to-toe drop M of between 0 mm and about 12 mm. The heel-to-toe drop M can be measured as a vertical distance (e.g., along the direction of gravity) when the footwear article 10 is on the ground between a heel top surface location $M_1$ on the sole assembly 200 that generally receives and supports a user's calcaneus bone and a forefoot top surface location $M_2$ on the sole assembly 200 that generally receives and supports a user's metatarsal-phalanges joints. In other words, the heel-to-toe drop M can be a measure of a height difference between a heel bottom and a forefoot bottom of a foot donning the footwear article 10. The top surface 200*a* of the sole assembly 200 may gradually transition between the heel top surface location $M_1$ and the forefoot top surface location $M_2$ to accommodate a natural fit (e.g., via an arcuate surface) for a users foot.

To provide a particular heel-to-toe drop geometry of the sole assembly 200, the outsole 220 may be have a constant thickness $T_O$ and the midsole 210 can have a varied thickness $T_M$ along the length of the sole assembly 200 to provide the particular heel-to-toe drop M. Alternatively, the outsole 220 can have a varied thickness $T_O$ along the length of the sole assembly 200 and the midsole 210 can have either constant or varied thickness $T_M$ to provide the particular heel-to-toe drop M.

Figure 9:
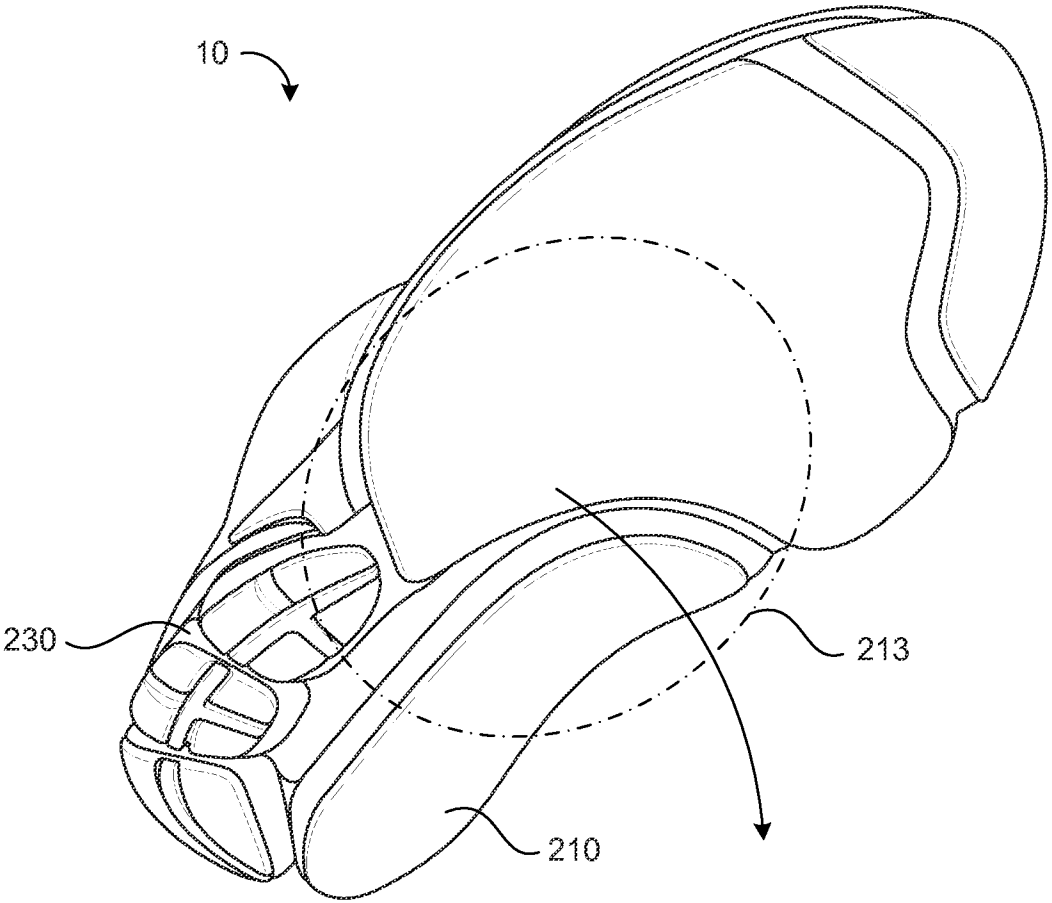
FIG. 9 is a perspective view of an exemplary article of footwear descending toward a ground surface.
Figure 10:
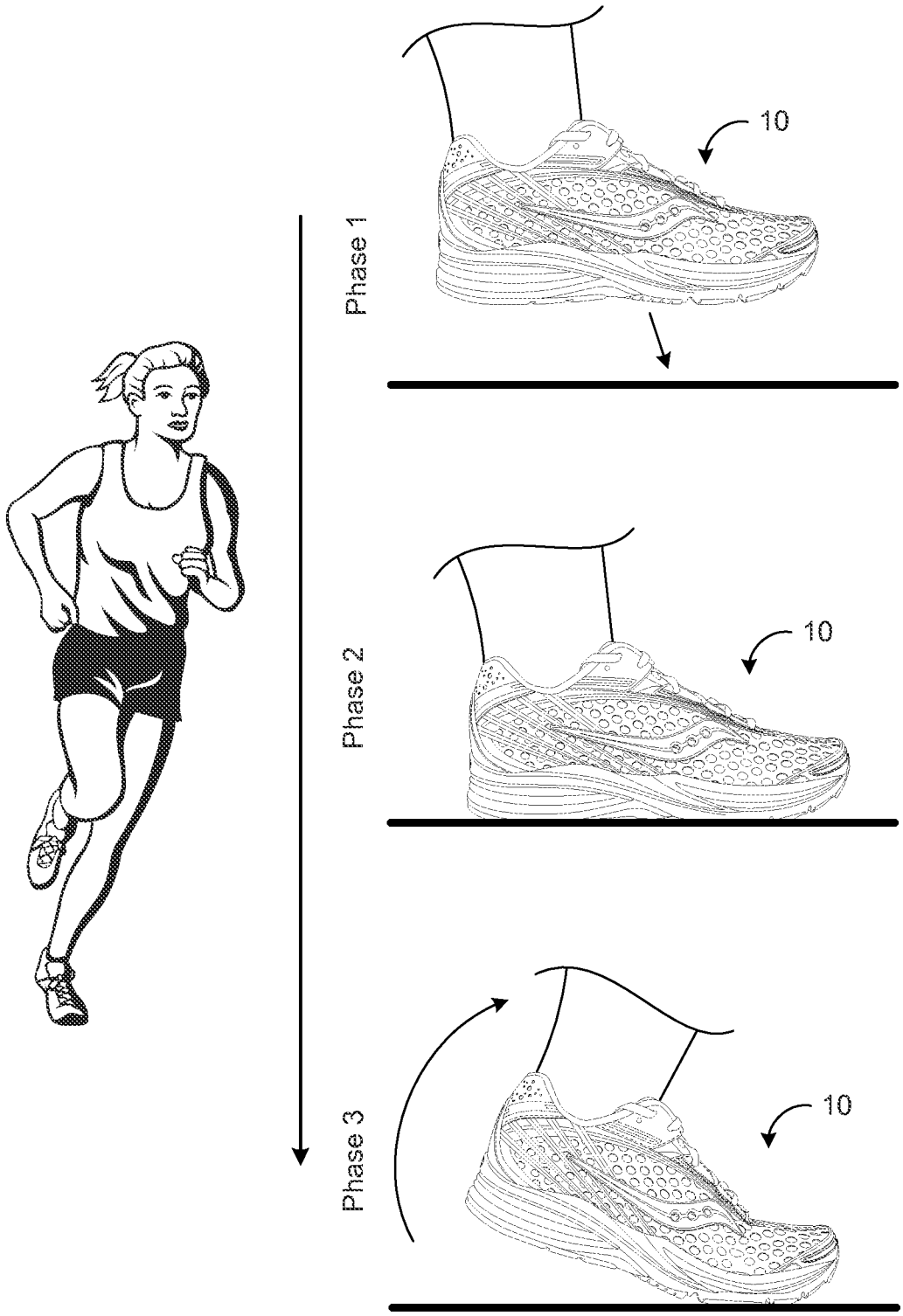
FIG. 10 is a schematic view of phases of a mid-foot strike running gait.

The midsole 210 and/or the outsole 220 can be configured to provide a particular heel-to-toe drop M that accommodates various running styles. For example, the sole assembly 200 may provide a heel-to-toe drop M of about 8 mm (or 8 mm+/−1 mm) A heel-to-toe drop M of 8 mm is 4 mm less than a typical heel-to-toe drop M of 12 mm for miming shoes. The change in footwear geometry allows the runner to change his/her stride to land further forward on the footwear article 10, relative to a heel-to-toe drop M greater than 8 mm, without reducing cushioning or stability of the footwear article 10. Reducing the heel-to-toe drop M to about 8 mm, approximately a 33% reduction from the 12 mm heel-to-toe drop M, can help a runner run more efficiently by positioning the runner further over the footwear article 10 upon initial ground contact, allowing or facilitating a mid-foot striking gait. Landing on a mid-foot region 213 of the sole assembly, as shown in FIGS. 9 and 10, can set the runner's ankles, calves, knees, quadriceps and/or hamstrings in a position that may better receive and absorb impact forces associated with striking the ground, relative to a heel-to-toe drop M greater than 8 mm. Moreover, a heel-to-toe drop M of about 8 mm can place the runner's legs in a relatively more coiled position, allowing the runner's legs to receive ground strike forces like a spring and then rebound to propel the runner forward.

Referring to FIG. 10, a runner's stride can have three phases. During phase 1, the footwear article 10 is descending toward the ground in a pose or manner that will determine whether the user experiences a heel strike, a forefoot strike, or a mid-foot strike with the ground. In the example shown, the runner arranges his/her foot for a mid-foot strike, where the mid-foot region 213 of the sole assembly 200 experiences initial contact with the ground. The heel-to-toe drop M of 8 mm (or about 8 mm) facilitates landing mid-foot. During phase 2, the outsole 220 of the footwear article 10 receives substantially full contact with the ground as the foot rolls forward. During phase 3, the runner pushes off the ground while rolling forward, such that the forefoot portion 202 of the sole assembly 200 experiences last contact with the ground before a recovery phase (not shown).

Figure 11:
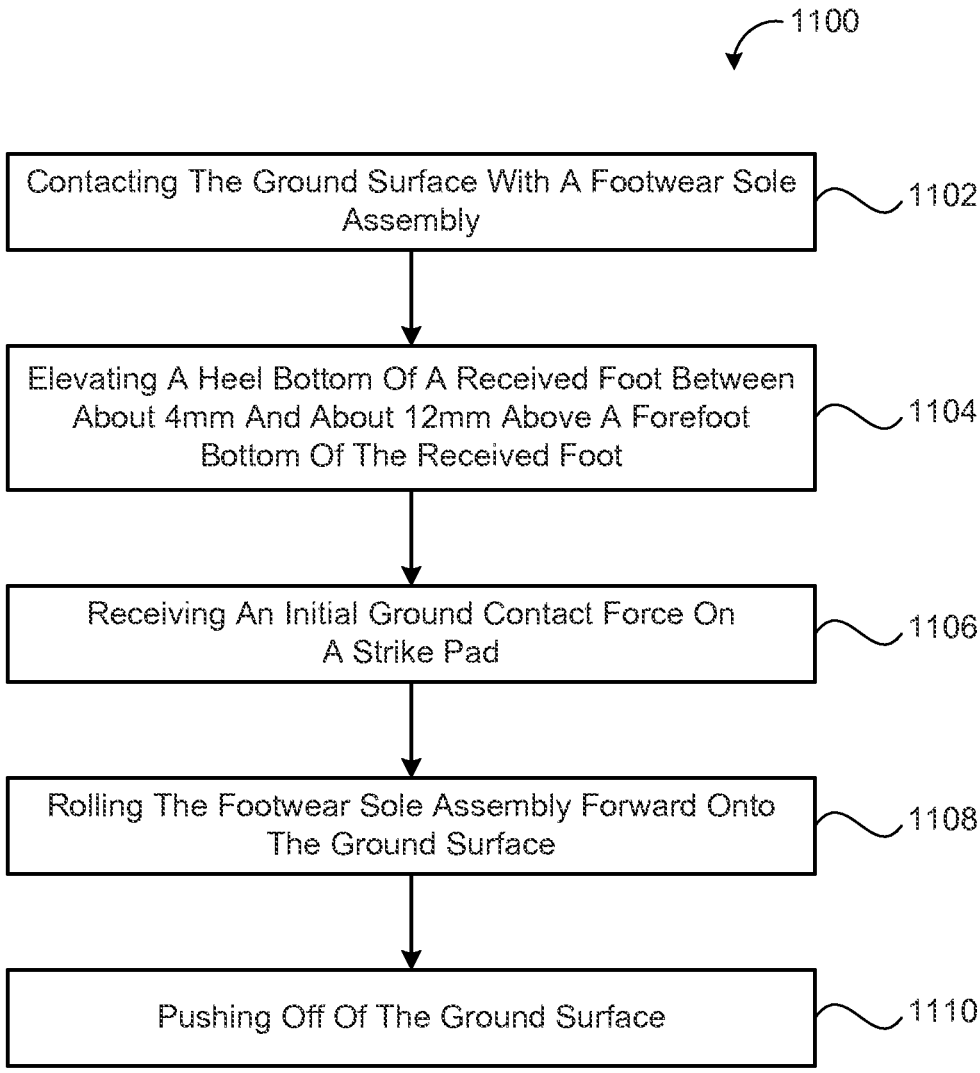
FIG. 11 is an exemplary arrangement of operations for a method of locomotion.

FIG. 11 provides an exemplary arrangement 1100 of operations for a method of locomotion across a ground surface. The method includes contacting 1102 the ground surface with a footwear sole assembly 200, elevating 1104 a heel bottom of a received foot between about 4 mm and about 12 mm above a forefoot bottom of the received foot, and receiving 1106 an initial ground contact force on a strike pad 230 disposed on a midsole 210 in at least a heel region 204 of the footwear sole assembly 200. The method further includes rolling 1108 the footwear sole assembly 200 forward onto the ground surface and pushing 1110 off of the ground surface, elevating the footwear sole assembly 200 away from the ground surface.

In some implementations, the method includes elevating the heel bottom of the received foot about 8 mm above the forefoot bottom of the received foot, allowing a mid-foot strike gait. The method may include receiving and supporting a calcaneus bone of the received foot on a heel top surface **200*h* of the footwear sole assembly 200 and receiving and supporting metatarsal-phalanges joints of the received foot on a forefoot top surface 200*f* of the footwear sole assembly 200 (FIG. 8). The heel top surface 200*h* of the footwear sole assembly 200 may be elevated between about 4 mm and about 12 mm above the forefoot top surface 200*f* of the footwear sole assembly 200. For example, the heel top surface 200*h* of the footwear sole assembly 200 may be elevated about 8 mm above the forefoot top surface 200*f* of the footwear sole assembly 200**.

The method may include easing the runner into a natural gait cycle through a gradual absorption of compressive forces by the strike pad 230. In some implementations, the strike pad 230 extends laterally from a lateral edge 211 of the midsole 210 to between about 10% and about 80% of a width W of the heel portion 204 of the sole assembly 200 (e.g., half way across the width W of the sole assembly heel portion 204). The method, in some examples, includes receiving initial lateral contact forces in the strike pad 230. The strike pad 230 may extend along a lateral periphery of the midsole 210 from the heel end 207 of the sole assembly 200 to the metatarsal portion 203, for example, defining a substantially J-shape from a bottom plan view perspective. In additional examples, the strike pad 230 defines a crescent, half-moon, substantially "U" shape, or an arcuate shape in a bottom plan view. The method, in additional examples, includes receiving initial lateral contact forces in the strike pad 230, by having the strike pad 230 disposed substantially in a lateral-heel portion 205 of the sole assembly 200.

In some examples, the strike pad 230 has a thickness $T_S$ (FIG. 2) of between about 5 mm and about 40 mm. Moreover, the strike pad thickness $T_S$ may decrease in thickness from the heel end 207 to the metatarsal portion 203 of the sole assembly 200 (e.g., gradually, linearly, non-linearly, exponentially, step-function, etc.).

A number of implementations have been described. Nevertheless, it will be understood that various modifications may be made without departing from the spirit and scope of the disclosure. Accordingly, other implementations are within the scope of the following claims.

What is claimed is:

1. A footwear sole assembly comprising:

a midsole;

a strike pad disposed on the midsole in at least a heel region of the footwear sole assembly the strike pad being constructed from an impact absorbing material that compresses in an elastic manner so as to provide impact absorbing cushion to a heel bottom of a wearer; and an outsole disposed on the strike pad;

wherein a heel top surface of the footwear sole assembly is elevated between about 4 mm and about 12 mm above a forefoot top surface of the footwear sole assembly, wherein the strike pad is disposed substantially only in a lateral heel portion of the sole assembly, wherein the strike pad extends laterally from a lateral edge of the midsole a distance between about 10% and about 80% of a width of a heel portion of the footwear sole assembly, wherein the heel top surface of the footwear sole assembly being elevated between about 4 mm and about 12 mm above a forefoot top surface of the footwear sole assembly positions a wearer of the footwear sole assembly farther forward over the footwear sole assembly to facilitate a mid-foot striking gait, wherein the outsole is joined with the strike pad below the strike pad, wherein the midsole is joined with the strike pad above the strike pad, wherein the midsole extends downwardly into and forms at least part of the strike pad, wherein the strike pad forms a J shape, having a first portion of the J shape wrap around the lateral heel portion and a second, bottom portion of the J shape wrap around at least part of a rear of the heel portion, wherein the strike pad is joined with the midsole at an upper portion of the strike pad, with a lower portion of the strike pad being separated into a plurality of strike pad parts, the plurality of strike pad parts separated from one another by a recess, wherein the outsole includes a plurality of separate individual outsole parts, each outsole part joined with a corresponding strike pad part, the plurality of outsole parts separated from one another by the recess.

2. The footwear sole assembly of claim 1, wherein the heel top surface of the footwear sole assembly generally receives and supports a calcaneus bone of a received foot and the forefoot top surface of the footwear sole assembly generally receives and supports metatarsal-phalanges joints of the received foot.

3. The footwear sole assembly of claim 2, wherein the heel top surface of the footwear sole assembly is elevated 8 mm above the forefoot top surface of the footwear sole assembly.

4. The footwear sole assembly of claim 1, wherein the strike pad has a durometer of about 40 Asker C to about 65 Asker C, so as to provide cushioning in a lateral heel portion of the footwear sole assembly.

5. The footwear sole assembly of claim 1, wherein the strike pad extends along a lateral periphery of the midsole from a heel end of the sole assembly to a metatarsal portion of the sole assembly.

6. The footwear sole assembly of claim 1, wherein the strike pad has a thickness of between about 5 mm and about 40 mm.

7. The footwear sole assembly of claim 1, wherein the strike pad has a decreasing thickness from a heel end of the sole assembly to a metatarsal portion of the sole assembly.

8. The footwear sole assembly of claim 7, wherein the strike pad thickness decreases linearly.

9. The footwear sole assembly of claim 8, wherein the heel top surface is elevated about 8 mm above the forefoot top surface of the footwear sole assembly, allowing the mid-foot striking gait.

10. A method of locomotion across a ground surface, the method comprising:

contacting the ground surface with a footwear sole assembly;

elevating a heel bottom of a received foot between about 4 mm and about 12 mm above a forefoot bottom of the received foot;

receiving an initial ground contact force on a strike pad disposed on a midsole in at least a heel region of the footwear sole assembly with the strike pad compressing in an elastic manner so as to provide impact absorbing cushion to the heel bottom of the wearer;

rolling the footwear sole assembly forward onto the ground surface; and pushing off of the ground surface, elevating the footwear sole assembly away from the ground surface, wherein the strike pad is disposed substantially only in a lateral heel portion of the sole assembly, wherein the strike pad extends laterally from a lateral edge of the midsole a distance between about 10% and about 80% of a width of a heel portion of the footwear sole assembly, wherein the strike pad is of an arcuate shape along the lateral edge, wherein the heel top surface of the footwear sole assembly being elevated between about 4 mm and about 12 mm above a forefoot top surface of the footwear sole assembly positions a wearer of the footwear sole assembly farther forward over the footwear sole assembly to facilitate a mid-foot striking gait, whereby the wearer better absorbs impact forces associated with striking the ground, wherein the outsole is joined with the strike pad below the strike pad, wherein the midsole is joined with the strike pad above the strike pad, wherein the midsole extends downwardly into and forms at least part of the strike pad, wherein the strike pad forms a J shape, having a first portion of the J shape wrap around the lateral heel portion and a second, bottom portion of the J shape wrap around at least part of a rear of the heel portion, wherein the strike pad is joined with the midsole at an upper portion of the strike pad, with a lower portion of the strike pad being separated into a plurality of strike pad parts, the plurality of strike pad parts separated from one another by a recess, wherein the outsole includes a plurality of separate individual outsole parts, each outsole part joined with a corresponding strike pad part, the plurality of outsole parts separated from one another by the recess.

11. The method of claim 10, comprising elevating the heel bottom of the received foot 8 mm above the forefoot bottom of the received foot, allowing a mid-foot striking gait.

12. The method of claim 10, comprising:

receiving and supporting a calcaneus bone of the received foot on a heel top surface of the footwear sole assembly; and receiving and supporting metatarsal-phalanges joints of the received foot on a forefoot top surface of the footwear sole assembly;

wherein the heel top surface of the footwear sole assembly is elevated between about 4 mm and about 12 mm above the forefoot top surface of the footwear sole assembly.

13. The method of claim 12, comprising elevating the heel top surface of the footwear sole assembly about 8 mm above the forefoot top surface of the footwear sole assembly.

14. The method of claim 10, comprising easing into a natural gait cycle through a gradual absorption of compressive forces by the strike pad.

15. The method of claim 10, wherein the strike pad has a durometer of about 40 Asker C to about 65 Asker C, so as to provide cushioning in a lateral heel portion of the footwear sole assembly.

16. The method of claim 10, comprising receiving initial lateral contact forces in the strike pad, the strike pad extending along a lateral periphery of the midsole from a heel end of the sole assembly to a metatarsal portion of the sole assembly.

17. The method of claim 10, comprising receiving initial lateral contact forces in the strike pad, the strike pad elastically compressing upon such receipt of the initial lateral contact forces.

18. The method of claim 10, wherein the strike pad has a thickness of between about 5 mm and about 40 mm.

19. The method of claim 10, wherein the strike pad has a decreasing thickness from a heel end of the sole assembly to a metatarsal portion of the sole assembly.

20. The method of claim 19, wherein the strike pad thickness decreases linearly from heel to toe of the footwear.

* * * * *